US006880711B2

(12) United States Patent
Collier

(10) Patent No.: US 6,880,711 B2
(45) Date of Patent: Apr. 19, 2005

(54) STORAGE RACK

(75) Inventor: James P. Collier, Sterling Heights, MI (US)

(73) Assignee: The Ultimate Group, LLC, Sterling Heights, MI (US)

( * ) Notice: Subject to any disclaimer, the term of this patent is extended or adjusted under 35 U.S.C. 154(b) by 50 days.

(21) Appl. No.: 10/442,722

(22) Filed: May 21, 2003

(65) Prior Publication Data

US 2003/0222038 A1 Dec. 4, 2003

Related U.S. Application Data

(60) Provisional application No. 60/385,172, filed on May 31, 2002.

(51) Int. Cl.[7] ..... A47F 7/00

(52) U.S. Cl. ..... 211/85.7; 211/85.3; 34/104

(58) Field of Search ..... 211/85.7, 85.3, 211/34; D6/552; 34/90, 103, 104

(56) References Cited

U.S. PATENT DOCUMENTS 3,645,009 A * 2/1972 Ketchum ..... 34/104
5,222,308 A * 6/1993 Barker et al. ..... 34/104
5,377,849 A * 1/1995 Martin ..... 211/85.7
5,469,635 A * 11/1995 Lamontagne et al. ..... 34/104
5,546,678 A 8/1996 Dhaemers
5,592,750 A * 1/1997 Eichten ..... 34/104
D394,926 S * 6/1998 Lindsay ..... D32/58
D398,469 S * 9/1998 Leong et al. ..... D6/552
5,862,924 A * 1/1999 Dumont ..... 211/85.7
6,073,783 A 6/2000 Allman
6,216,887 B1 * 4/2001 Soo ..... 211/85.7
6,263,591 B1 7/2001 La Porte
6,327,792 B1 * 12/2001 Hebert ..... 34/104
6,591,994 B1 * 7/2003 Bearss ..... 211/85.7
D487,831 S * 3/2004 Savoie ..... D32/58

* cited by examiner

*Primary Examiner*—Robert W. Gibson, Jr.
(74) *Attorney, Agent, or Firm*—Reising, Ethington Barnes, Kisselle, P.C.

(57) ABSTRACT

A storage rack provides a convenient means to both dry and store often cumbersome athletic clothing and equipment. The storage rack is of an endo-type design in the sense that the stored athletic equipment and clothing is substantially draped over or encapsulated various appendages of a hollow shell of the rack. Internal surfaces of the athletic equipment and clothing are dried by a series of air flow apertures carried by each appendage which communicate inwardly with a common air chamber held at superatmospheric pressure and defined by the shell. Preferably an inlet supply air passage is also carried by the shell for receiving superatmospheric air into the air chamber.

18 Claims, 3 Drawing Sheets

STORAGE RACK

REFERENCE TO RELATED APPLICATION

Applicant claims the benefit of provisional application Ser. No. 60/385,172, filed May 31, 2002.

TECHNICAL FIELD

The present invention relates to a storage rack and more particularly to a hollow endo-type storage rack for the drying of athletic equipment and clothing.

BACKGROUND OF THE INVENTION

Athletics such as football and hockey, amongst others, are without question a favorite national past time. Consequently, it is of no surprise that children begin active participation in sporting activities at a young age, often through organized minor leagues and scholastic athletic programs. The equipment and clothing necessary to participate in many sports includes a protective helmet, a variety of body pads and related clothing, gloves, special shoes or skates, and jerseys. This equipment and clothing is often bulky and cumbersome; stored within closed, airless, lockers at athletic facilities, or clumped together within athletic bags. Moreover, where the athletes are children, the equipment and clothing is often strewn about the home to a parent's dismay.

To complicate matters, the sporting equipment and clothing is often damp from body sweat and exposure to rainy weather. Damp clothing is prone to mildew, staining and unpleasant odor, especially when not properly stored and/or immediately dried. Moreover, conventional drying methods for everyday clothing such as a rotating drum-type clothes dryer are not conducive to the drying of athletic equipment which may include integrated hard materials such as plastic or metal that can damage surrounding supportive fabrics. Also, known drying methods typically dry from the outside-in which is not preferred for items such as shoes and gloves which are primarily damp on the inside from body sweat. Thus, a partially dried piece of equipment, such as a glove, will still feel uncomfortably damp and cold against the bare hand of the athlete. Yet further, because known drying methods typically do not function as an organized storage area for sporting equipment and clothing, the athlete or parent must be bothered with remembering to move the equipment and clothing from the drying means and to a designated storage area.

SUMMARY OF THE INVENTION

A storage rack provides a convenient means to both dry and store often cumbersome athletic clothing and equipment. The storage rack is of an endo-type design in the sense that the stored athletic equipment and clothing is substantially draped over or encapsulates various appendages of a hollow shell of the rack. Internal surfaces of the athletic equipment and clothing are dried by a series of air flow apertures carried by each appendage which communicate inwardly with a common air chamber held at superatmospheric pressure and defined by the shell. Preferably an inlet supply air passage is also carried by the shell for receiving superatmospheric air into the air chamber.

Advantages and features of the storage rack of the present invention are convenience in the organization of bulky athletic equipment and clothing. Yet another advantage of the storage rack is the ability to dry athletic equipment and clothing from the inside-out thus reducing unpleasant odors, eliminating mildew growth, extending the useful life of the athletic clothing and equipment and adding comfort to the wearer of the athletic equipment and clothing.

BRIEF DESCRIPTION OF THE DRAWINGS

The presently preferred embodiments of the invention are disclosed in the following description and in the accompanied drawings wherein.

DETAILED DESCRIPTION OF THE EMBODIMENTS

Figure 1:
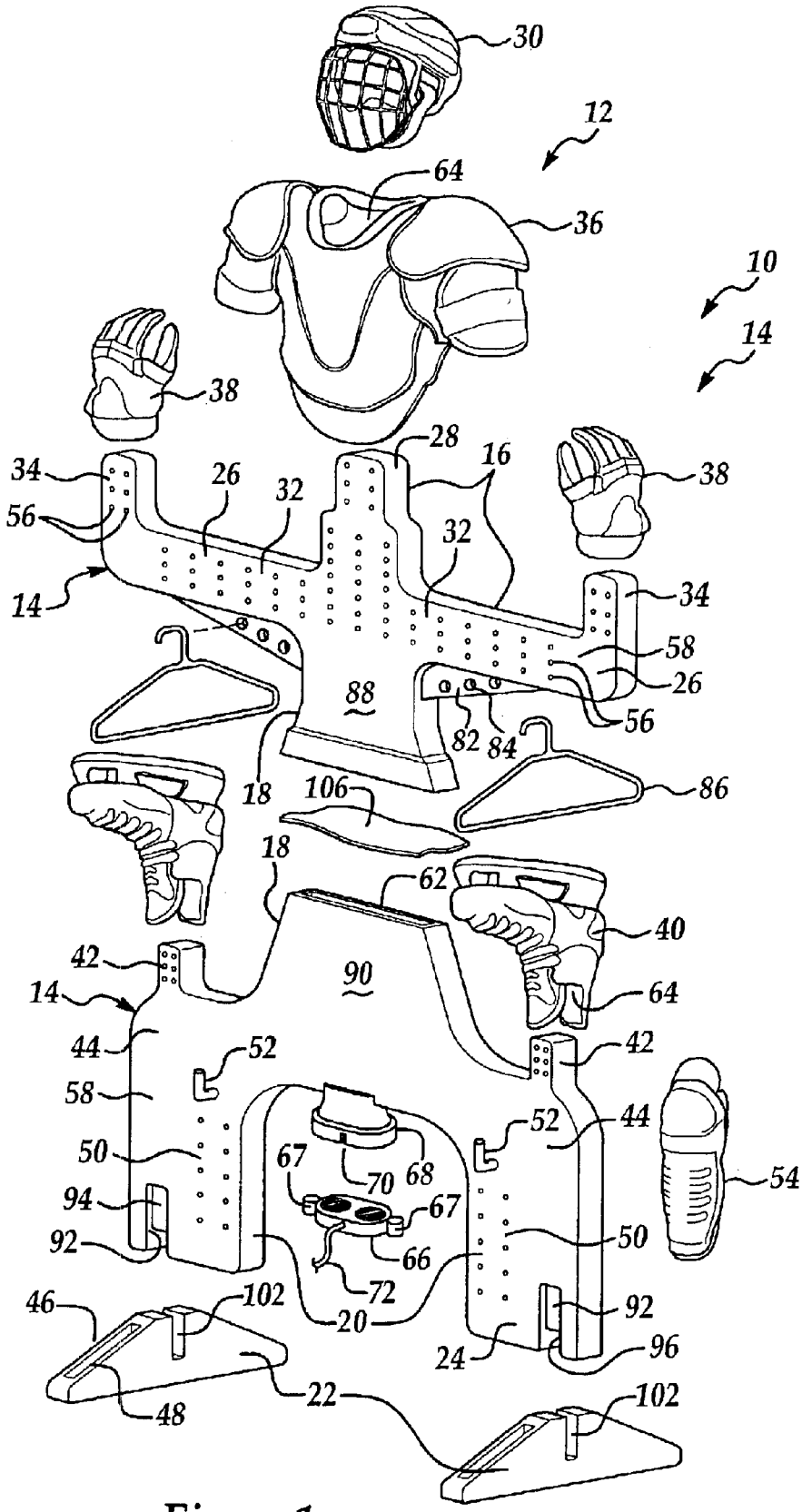
FIG. 1 is an exploded perspective view of a storage of the present invention.
Figure 2:
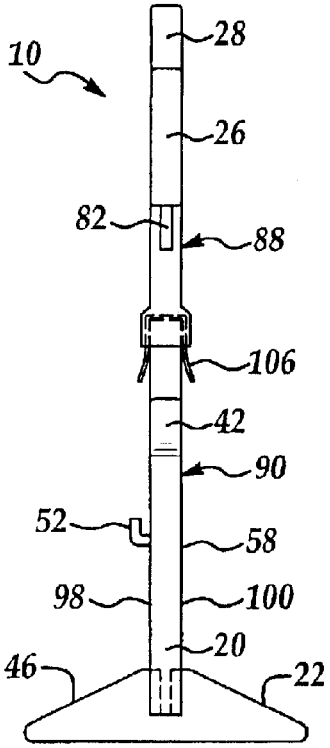
FIG. 2 is a side view of the storage rack.
Figure 3:
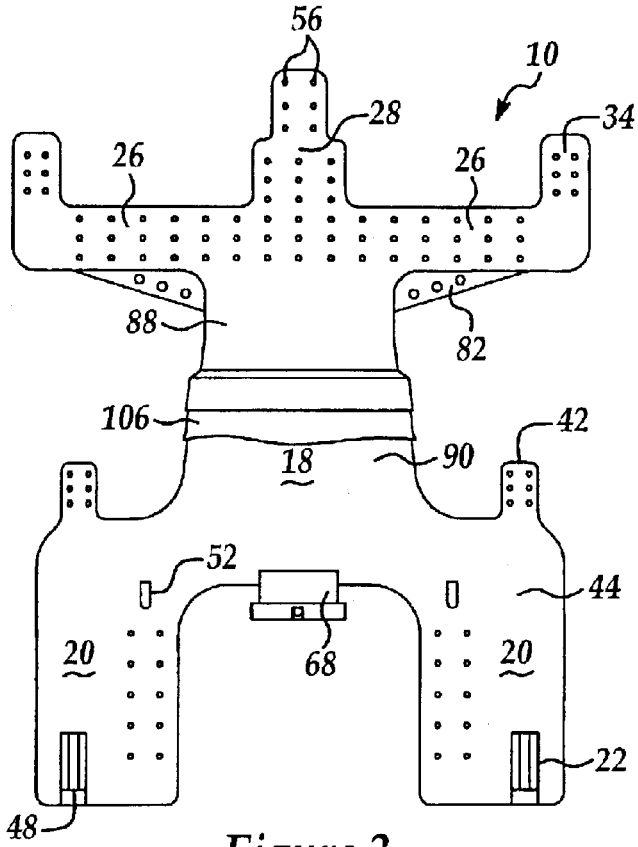
FIG. 3 is a front view of the storage rack.

Referring to FIGS. 1–3, a storage rack 10 of the present invention stores and dries athletic equipment and clothing 12 for football, hockey and a wide variety of other sports. A hollow shell 14 of the storage rack 10 generally resembles an upright stature of a human being and has a series of appendages 16 or branches similar to a human body which project from a central torso 18 of the shell 14. The torso 18 is elevated by a pair of bent or crouching legs 20 of the appendages 16. Stabilizing the torso 18 in the upright or substantially vertical position are a substantially horizontal pair of elongated feet 22 press fitted to a distal or lower end 24 of each respective one of the pair of legs 20. Spaced above the legs 20, with the torso 18 extending vertically therebetween, are a pair of arms 26 of the appendages 16 extending substantially horizontal. Projecting upward from the torso 18, and between the oppositely projecting arms 26, is a head 28, which generally completes the human image and is highly suggestive of where various components of the athletic equipment and clothing 12 should be stored.

For instance, the head 28 of the appendages 16 extends upward to support a protective helmet 30 of the athletic equipment and clothing 12. Each one of the arms 26 has a horizontal portion 32 disposed generally between the head 28 and a respective vertically projecting hand or distal portion 34 of the arms 26. Draped and stored over the two horizontal portions 32 and hanging downward to partially cover the torso 18 is a shoulder pad 36 of the athletic equipment and closing 12 with the head 28 projecting upward beyond the shoulder pads 36. The distal portions or hand 34 support, and are generally encased by, respective left and right gloves 38 commonly used in the sport of hockey. Athletic shoes 40 such as cleats for the sport of football or ice skates for hockey, fit invertly over a pair of stanchions 42 projecting upward from a bent knee portion 44 of each respective one of the pair of legs 20. Moreover, an upward surface 46 of each foot 22 carries a slit 48 which snugly encases and protects the blades of the shoes or ice skates 40 thus storing the skates in an upright position. If the skates 40 are stored within the slits 48, the pair of stanchions 42 can serve to store socks (not shown) or any other type of clothing having a tubular design. A lower or shin portion 50 of each leg 20 supports a hook member or device 52 for hanging shin pads 54 of the athletic equipment and clothing 12.

All of the appendages 16 have a series of apertures 56 which extend through the shell 14 between an external face 58 being in direct contact with the athletic equipment and clothing 12 and an internal face 60 which defines an air chamber 62. The apertures 56 flow at superatmospheric pressure from the air chamber 62 and against inward damp surfaces 64 of the athletic equipment 12. In this way, the storage rack 10 dries the athletic equipment and clothing 12 from the inside-out.

Figure 4:
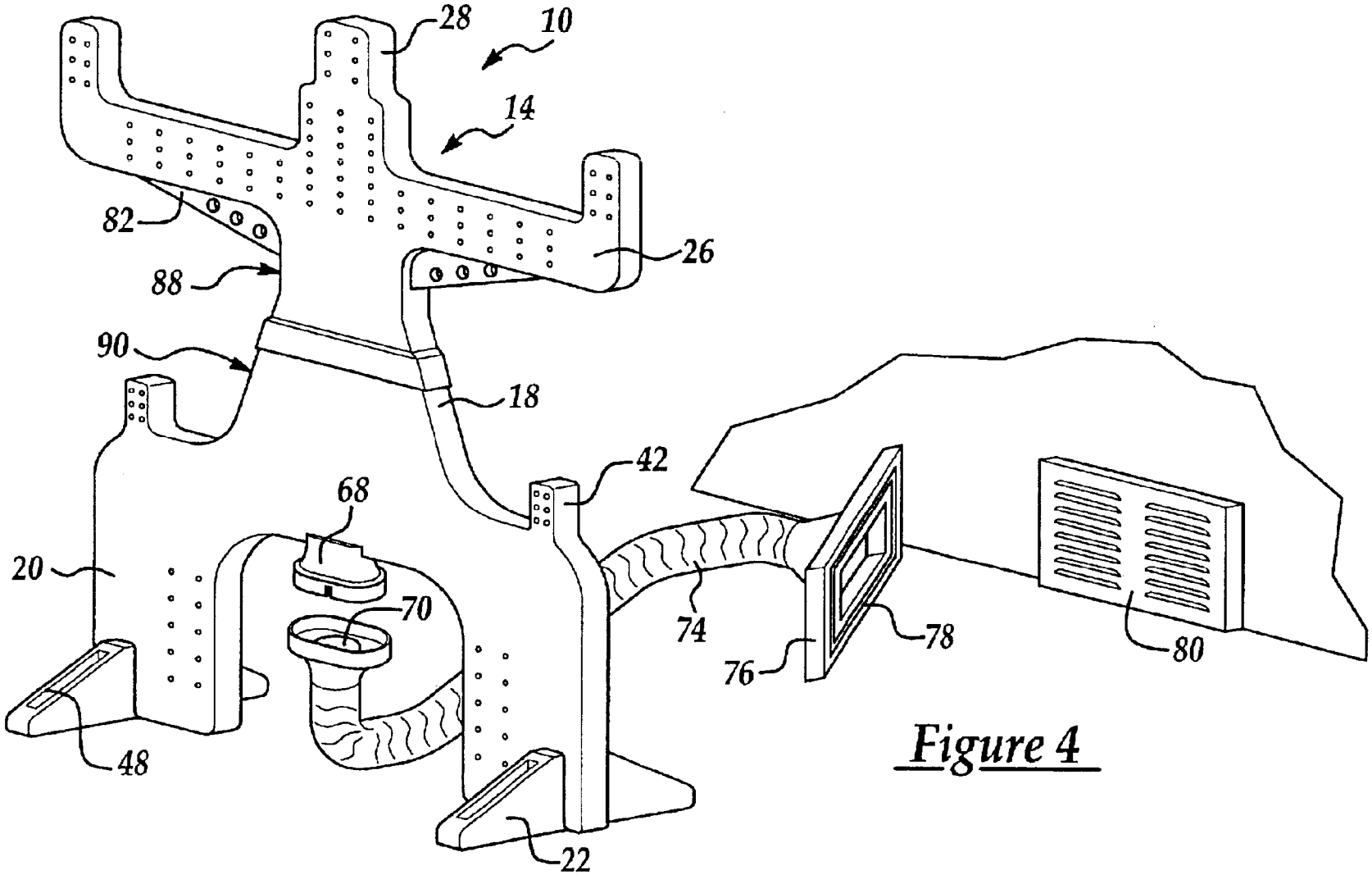
FIG. 4 is a perspective view of a second embodiment of a storage rack.

An electric fan 66 engages or press fits to a crotch or tail member 68 extending generally downward between the pair of legs 20 and induces air flow through an air passage 70 defined by the crotch member 68, and into the air chamber 62. The fan 66 has an integrated timer 67, an on/off switch 69 with a power cord 72 which plugs into a standard alternating current outlet or wall receptacle commonly found in residential homes. When the user turns the switch 69 on, the timer 67 is activated allowing the fan 66 to run for a pre-established period of time before automatically shutting down. Referring to FIG. 4, the supply air passage 70 is extended by a flexible duct 74 as an alternative retrofit press fitted at one end to the crotch member 68 and attached at the opposite end to a frame 76 having a magnetic strip 78 which engages a metallic air supply wall or floor grill 80 commonly found in residential homes. In this way the storage rack 10 utilizes the forced air heating or cooling system of a residential home to flow air into the hollow shell 14 thus drying the athletic equipment and clothing 12.

A reinforcement webbing or member 82 engages unitarily to the external face 58 at each horizontal portion 32 and the torso 18 for supporting the horizontal portions 32 along with the weight of the shoulder pads 36 and the gloves 38 from below. Each webbing 18 has a series of eyelets 84 for suspending a removable hanger 86 or any other type of hooked storage device commonly used for the hanging or storage of clothing, such as pants.

The storage rack 10 is preferably made of a non-rusting material such as aluminum, stainless steel, chrome plated steel, coated steel or plastic. Plastic is a preferred material because it possesses structural strength while being lightweight and relatively inexpensive. Furthermore, the plastic is preferably molded producing a wide variety of shapes, sizes, and features. To assist in the molding process and reduce costs of shipping and handling, the storage rack 10 is shipped in a disassembled state having generally five separate parts which include a top member 88 of the shell, a bottom member 90 of the shell, the fan 66 and the pair of horizontal elongated feet 22. The shell 14 of the storage rack 10 is divided into the top member 88 and the bottom member 90 which press together during assembly. Likewise, each foot 22 press fits to the respective leg 20 for quick and easy assembly. The plastic may be manufactured in a variety of colors with the addition of decals (not shown) to coordinate with and display loyalty to a favorite professional athletic team.

Each foot 22 of the free-standing storage rack 10 press fits to the bottom member 90 of the hollow shell 14 at each leg 20 via a slot 92 defined laterally by a first and second side 94, 96 of the exterior surface 98 of the shell 14. The slots 92 extend from the front portion 98 to the back portion 100 of the exterior surface of shell 14. The distance between the first and second sides 94, 96 is generally equal to the lateral width or thickness of each foot 22. Each foot 22 also has a laterally extending slot 102 which mates with the respective leg 20. Once the feet 22 are press fitted to the respective legs 20, the storage rack 10 is capable of maintaining an upright stature. The storage rack 10 can also be supported in the upright stature by an existing structure so that the feet 22 are not required. For instance, the hollow shell 14 of the storage rack 10 can be conveniently supported against a backside of an entry door.

Referring to FIGS. 1 and 2, the athletic equipment and clothing 12 is deorderized by a scenting element 106 illustrated as a permeable sheet or cloth substantially disposed in the air chamber 62 and held in-place by being sandwiched between the press fitted interface of the top member 88 to the bottom member 90. The scenting element 106 may also be any variety of other shapes and materials including that of pellets held within a screen-like basket disposed accessibly within the air chamber 62.

Figure 5:
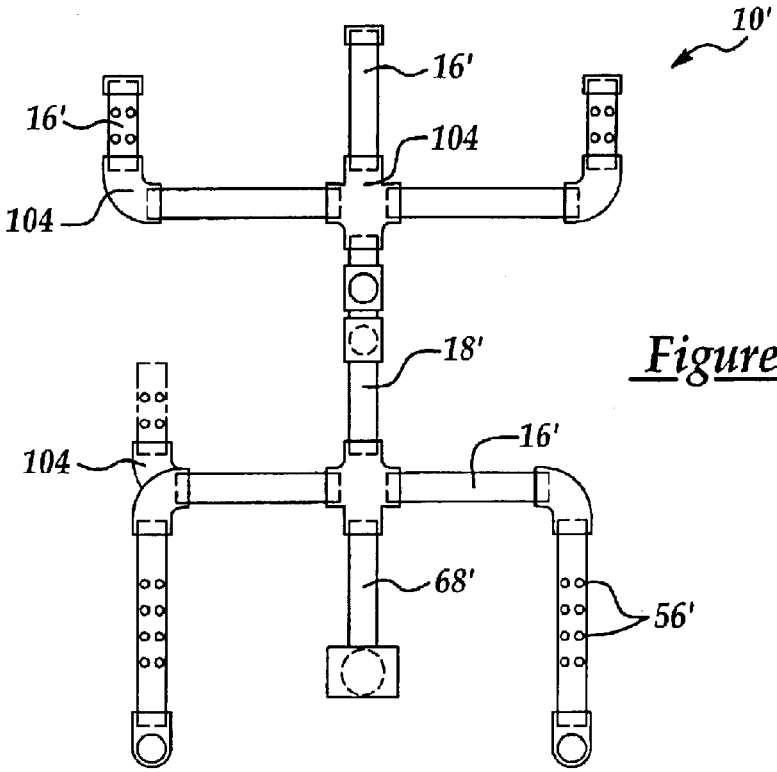
FIG. 5 is a front view of a third embodiment of a storage rack.

Referring to FIG. 5, a second embodiment of a storage rack 10' may also be made of a conventional piping material such as polyvinyl chloride piping, PVC, and with a variety of pipe fittings 104 to form the various appendages 16'. Moreover, the storage rack 10' need not be in the shape of a human being, but may instead have appendages 16' strategically placed to minimize required storage space, yet still have the endo-type drying features of the internal air chamber and a series of apertures. For instance, the storage rack 10' can be tree-like in design wherein the appendages 16' are a series of hollow branches and a torso 18' is analogous to a hollow trunk having a diameter equal to or greater than the diameter of the branches.

While the forms of the invention herein discloses constitute presently preferred embodiments, many others are possible. For instance, the fan 66 could be reversed in direction creating a vacuum pressure within the air chamber. This embodiment could be used to evacuate unpleasant odors of the athletic equipment from a room. It is not limited herein to mention all the possible equivalent forms or ramifications of the invention. It is understood that the terms used herein are merely descriptive rather than limited and that various changes maybe made without departing from the spirit or scope of the invention.

What is claimed is:

1. A storage rack for the drying and storage of athletic clothing and equipment having outward surfaces which face outward from the athlete when worn and inward surfaces which bear upon the body of the athlete when being worn, the drying rack comprising:

a hollow shell having an external face and an internal face defining an air chamber;

an air passage carried by the shell and communicating with the air chamber;

a plurality of apertures extending through the shell, wherein superatmospheric air flows from the air chamber, through the aperture and against the inward surface of the athletic clothing-and-equipment;

wherein the air passage is constructed and arranged to flow superatmospheric air into the air chamber;

a frame engaged to a ventilation grill;

a flexible duct defining the air supply passage and engaged between the frame and the shell; and wherein forced air flowing through the ventilation grill flows into the air chamber as the superatmospheric air.

2. The storage rack set forth in claim 1 wherein the ventilation grill is metallic and a magnetic strip of the frame secures the frame to the grill.

3. A storage rack for the drying and storage of athletic clothing and equipment having outward surfaces which face outward from the athlete when worn and inward surfaces which bear upon the body of the athlete when being worn, the drying rack comprising:

a hollow shell having an external face and an internal face defining an air chamber:

an air passage carried by the shell and communicating with the air chamber;

a plurality of apertures extending through the shell, wherein superatmospheric air flows from the air chamber, through the aperture and against the inward surface of the athletic clothing-and-equipment;

the external face having a front portion, a back portion, a first side, and an opposing second side, wherein the first and second sides extend between the front and back portions;

a slot of the shell opened downwardly and defined between the first and second sides;

an elongated foot member disposed substantially horizontally and perpendicular to the shell; and a slot carried by and extending laterally through the foot member, wherein the foot member is press fitted into the slot of the shell and the shell is press fitted into the slot carried by the foot member.

4. A storage rack for the drying and storage of athletic clothing and equipment having outward surfaces which face outward from the athlete when worn and inward surfaces which bear upon the body of the athlete when being worn, the drying rack comprising:

a hollow shell having an external face and an internal face defining an air chamber;

an air passage carried by the shell and communicating with the air chamber;

a plurality of apertures extending through the shell, wherein superatmospheric air flows from the air chamber, through the aperture and against the inward surface of the athletic clothing-and-equipment:

a hollow torso of the shell communicating directly with the air passage;

a plurality of hollow appendages of the shell, wherein one of the plurality of hollow appendages communicates directly with the hollow torso;

wherein the plurality of apertures are distributed amongst the plurality of hollow appendages and the athletic clothing and equipment is draped selectively over respective ones of the plurality of hollow appendages;

a pair of legs of the plurality of hollow appendages extending downward from the hollow torso;

a pair of elongated feet members disposed perpendicular to the pair of legs, wherein each one of the pair of elongated feet members is engaged to a respective one of the pair of legs for bracing the torso in an upright position;

a pair of arms of the plurality of hollow appendages spaced above the pair of legs; and a pair of gloves supported by the pair of arms for drying.

5. The storage rack set forth in claim 4 also comprising a head of the plurality of hollow appendages projecting upward from the hollow torso between the pair of arms.

6. The storage rack set forth in claim 4 comprising a pair of stanchions of the plurality of hollow appendages wherein each one of the pair of stanchions project upward from each respective one of the pair of legs.

7. The storage rack set forth in claim 4 comprising:

a top member of the torso;

a bottom member of the torso press fitted to the top member;

a first arm of the pair of arms projecting outward from the top member;

a second arm of the pair of arms projecting outward from the top member and in an opposite direction from the first arm; and the pair of legs projecting outward from the bottom member.

8. A storage rack for the drying and storage of athletic clothing and equipment having outward surfaces which face outward from the athlete when worn and inward surfaces which bear upon the body of the athlete when being worn, the drying rack comprising:

a hollow shell having an external face and an internal face defining an air chamber;

an air passage carried by the shell and communicating with the air chamber;

a plurality of apertures extending through the shell, wherein superatmospheric air flows from the air chamber, through the aperture and against the inward surface of the athletic clothing-and-equipment;

a hollow torso of the shell communicating directly with the air passage;

a plurality of hollow appendages of the shell wherein one of the plurality of hollow appendages communicates directly with the hollow torso;

wherein the plurality of apertures are distributed amongst the plurality of hollow appendages and the athletic clothing and equipment is draped selectively over respective ones of the plurality of hollow appendages;

a pair of legs of the plurality of hollow appendages extending downward from the hollow torso;

a pair of elongated feet members disposed perpendicular to the pair of legs, wherein each one of the pair of elongated feet members is engaged to a respective one of the pair of legs for bracing the torso in an upright position;

a pair of arms of the plurality of hollow appendages disposed above the pair of legs; and a reinforcement webbing engaged between the exterior face at the torso and the exterior face at each one of the pair of arms.

9. The storage rack set forth in claim 8 wherein the reinforcement webbing is disposed below the pair of arms and has an eyelet for suspending a hanger.

10. A storage rack for the drying and storage of athletic clothing and equipment having outward surfaces which face outward from the athlete when worn and inward surfaces which bear upon the body of the athlete when being worn, the drying rack comprising:

a hollow shell having an external face and an internal face defining an air chamber;

an air passage carried by the shell and communicating with the air chamber;

a plurality of apertures extending through the shell, wherein superatmospheric air flows from the air chamber, through the aperture and against the inward surface of the athletic clothing-and-equipment;

a hollow torso of the shell communicating directly with the air passage;

a plurality of hollow appendages of the shell, wherein one of the plurality of hollow appendages communicates directly with the hollow torso;

wherein the plurality of apertures are distributed amongst the plurality of hollow appendages and the athletic clothing and equipment is draped selectively over respective ones of the plurality of hollow appendages;

a pair of legs of the plurality of hollow appendages extending downward from the hollow torso;

a pair of elongated feet members disposed perpendicular to the pair of legs, wherein each one of the pair of elongated feet members is engaged to a respective one of the pair of legs for bracing the torso in an upright position; and wherein the air passage is defined by a crotch member disposed between the pair of legs.

11. The storage rack set forth in claim 10 wherein the hollow shell is made of plastic.

12. The storage rack set forth in claim 11 wherein the hollow shell is made of molded plastic.

13. The storage rack set forth in claim 10 wherein the hollow shell is made of polyvinyl chloride piping.

14. The storage rack set forth in claim 10 comprising a scenting element disposed in the air chamber.

15. An endo-type storage rack for organizing athletic clothing and equipment, the storage rack comprising:

a torso having an upright stature;

a first bent leg projecting downward from the torso;

a first stanchion projecting upward from the first bent leg for storing a first shoe in an inverted position;

a first foot engaged to and disposed perpendicular to the first leg;

a first arm engaged directly to the torso and spaced above the first leg for storing a first glove; and a head projecting upward from the torso for storing a helmet.

16. The endo-type storage rack set forth in claim 15 comprising:

a second bent leg projecting downward from the torso;

a second stanchion projecting upward from the second bent leg for storing a second shoe in an inverted position;

a second foot engaged to and disposed perpendicular to the first leg and parallel to the first foot; and a second arm projecting from the torso and away from the first arm and spaced above the second leg for storing a second glove.

17. The endo-type storage rack set forth in claim 16 wherein the first and second arms each have a horizontal portion engaged directly to the torso and a distal vertical portion projecting from the horizontal portion, and wherein the head is centered horizontally between the horizontal portions of the first and second arms, the first and second gloves are fitted over the respective distal vertical portions, and shoulder pads are draped over the horizontal portion.

18. The endo-type storage rack set forth in claim 17 comprising:

an air chamber defined by the torso, the first and second arms, the head, the first and second legs and the first and second stanchions;

an air inlet passage carried by the torso and communicating with the air chamber for supplying superatmospheric air to the air chamber; and a plurality of apertures communicating with the air chamber and distributed amongst the first and second arms, the head, and the first and second stanchions.

* * * * *

UNITED STATES PATENT AND TRADEMARK OFFICE

CERTIFICATE OF CORRECTION

PATENT NO. : 6,880,711 B2
DATED : April 19, 2005
INVENTOR(S) : James P. Collier

It is certified that error appears in the above-identified patent and that said Letters Patent is hereby corrected as shown below:

Title page,
Item [57], ABSTRACT,
Line 5, after "over" insert -- , --.
Line 5, delete "encapsulated" and insert -- encapsulates --.
Line 10, after "Preferably" insert -- , --.

Column 2,
Line 44, delete "closing" and insert -- clothing --.

Column 5,
Line 28, delete "aperture" and insert -- plurality of apertures --.

Column 6,
Line 14, delete "aperture" and insert -- plurality of apertures --.

Signed and Sealed this

Ninth Day of August, 2005

JON W. DUDAS
*Director of the United States Patent and Trademark Office*